US007984580B1

(12) United States Patent
Giauque et al.

(10) Patent No.: US 7,984,580 B1
(45) Date of Patent: Jul. 26, 2011

(54) ADJUSTABLE BUTT STOCK ASSEMBLY

(75) Inventors: Timothy Delamare Giauque, Columbia, SC (US); John Michael Beville, Blythewood, SC (US); Thomas Arnold Mooty, Columbia, SC (US); Dustin Keith Sroufe, Rockhill, SC (US)

(73) Assignee: FN Manufacturing, LLC, Columbia, SC (US)

( * ) Notice: Subject to any disclaimer, the term of this patent is extended or adjusted under 35 U.S.C. 154(b) by 358 days.

(21) Appl. No.: 12/335,148

(22) Filed: Dec. 15, 2008

Related U.S. Application Data

(60) Provisional application No. 61/013,486, filed on Dec. 13, 2007, provisional application No. 61/075,501, filed on Jun. 25, 2008.

(51) Int. Cl.
*F41C 23/14* (2006.01)

(52) U.S. Cl. ..... 42/73; 42/74

(58) Field of Classification Search ..... 42/71.01, 42/71.02, 72–74, 75.01, 75.03
See application file for complete search history.

(56) References Cited

U.S. PATENT DOCUMENTS 2,100,514 A * 11/1937 Miller et al. ..... 42/71.01
4,896,446 A * 1/1990 Gregory ..... 42/73
5,235,764 A * 8/1993 Perazzi ..... 42/73
5,933,997 A * 8/1999 Barrett ..... 42/73
6,481,142 B1 * 11/2002 McCarthy ..... 42/74
6,651,371 B2 * 11/2003 Fitzpatrick et al. ..... 42/72
7,162,822 B1 * 1/2007 Heayn et al. ..... 42/73
7,398,616 B1 * 7/2008 Weir ..... 42/73
7,640,688 B2 * 1/2010 Oz ..... 42/73
7,793,453 B1 * 9/2010 Sewell et al. ..... 42/73
7,805,873 B2 * 10/2010 Bentley ..... 42/74
2002/0053156 A1 * 5/2002 McCarthy ..... 42/74
2004/0226211 A1 * 11/2004 Keeney et al. ..... 42/71.01
2006/0254111 A1 * 11/2006 Giauque et al. ..... 42/72
2008/0110074 A1 * 5/2008 Bucholtz et al. ..... 42/1.06
2008/0236017 A1 * 10/2008 Fitzpatrick et al. ..... 42/73

* cited by examiner

*Primary Examiner* — Bret Hayes
*Assistant Examiner* — Reginald Tillman, Jr.
(74) *Attorney, Agent, or Firm* — Michael A. Mann; Nexsen Pruet, LLC

(57) ABSTRACT

A semi-infinitely-adjustable butt stock assembly. A butt stock is slidably affixed to a buffer stem. An over-center lock is attached to the butt stock adjacent to the buffer stem. The user can disengage the over-center lock from the buffer stem by rotating a lever thereby permitting the longitudinal position of the butt stock to be adjusted relative to the buffer plate. To secure the butt stock at the desired position, the user rotates the lever in the opposite direction causing the over-center lock to re-engage the buffer stem. A cheek rest overlaying the butt stock and biased forward with respect thereto is adjustable vertically with respect to the butt stock by manually moving the cheek rest aft, adjusting it vertically, and releasing the cheek rest.

16 Claims, 10 Drawing Sheets

ADJUSTABLE BUTT STOCK ASSEMBLY

CROSS REFERENCE TO RELATED APPLICATIONS

This application claims priority to the provisional application bearing Ser. No. 61/013,486 filed Dec. 13, 2007 and the provisional application bearing Ser. No. 61/075,501 filed Jun. 25, 2008.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF THE INVENTION

The present invention relates to rifle stocks in general and to butt stocks in particular.

The typical butt stock is a simple, rigid component extending from the back of the rifle and engaging the user's shoulder when the rifle is being used. The distance between a rifle's trigger and the aft-most portion of the butt stock is known in the art as the pull length. The pull length for a rifle having a typical, rigid butt stock is fixed.

A rifle having an adjustable pull length is preferable to one having a fixed pull length for a number of reasons. For example, when a rifle is used by more than one user, it is important for each user to be able to adjust the pull length as desired for comfort and accurate shooting. In addition, even if the rifle is used by a single user, depending on the manner in which the rifle is being used (standing v. prone) and whether the rifle is equipped with optics (e.g., a scope) or other aiming devices (e.g., a bipod), the user may need to adjust the pull length for optimal comfort and accuracy.

In addition to the length of the butt stock being adjustable, it is also important for the top portion of the butt stock, called the cheek rest, to be adjustable. The height of the cheek rest on a traditional rigid butt stock is fixed. Depending on the user and manner in which the rifle is being used, the fixed height of the cheek rest may be uncomfortable for the user or serve as an impediment to accurate shooting (i.e. inhibit the user from properly viewing the reticle). It would be advantageous, therefore, to be able to adjust the height of the cheek rest to maximize shooting accuracy and the user's comfort.

In addition to being adjustable, it is also important for a rifle butt stock to be simple and reliable, having a small number of parts, quickly and quietly adjustable, and very rugged. This is especially true for rifles used in combat. Rifles that are used in the prone position need to be especially rugged due to the fact that they are often slammed to the ground when the user is transitioning from a standing to a prone position and then used as support when the user is transitioning from the prone to the standing position. Accordingly, there remains a need for simple, reliable, and rugged butt stock that can be adjusted quickly, quietly, and easily.

It is also important for a butt stock be lightweight and easily disassembled for repair or cleaning. Rifles are often hand carried by a single individual for long distances over uneven terrain. In order to minimize the energy required to carry the rifle, it is important for the rifle to be as light as possible. It is also important for the rifle to be kept clean. A rifle exposed to grit, sand, and other particulate is more likely to jam or otherwise malfunction. Tools for disassembling a rifle are rarely available in the field, however, and thus the user must be able to break down the rifle without the assistance of specialized tools. Accordingly, there remains a need for a lightweight butt stock that can be easily broken down without the use of specialized tools for cleaning and maintenance.

SUMMARY OF THE INVENTION

According to its major aspects and briefly recited, the present invention is an adjustable butt stock assembly. The butt stock is made of a rugged, rigid material such as plastic, metal, fiberglass, or carbon fiber and has a cylindrical hole running therethrough in the fore to aft directions. On the aft end of the butt stock is a butt plate, also made of a rigid, durable material. The butt plate is securely fastened to the butt stock and engages the user's shoulder when the user aims and fires the rifle.

Fitting inside the butt stock and extending fore to aft therein is a substantially cylindrical buffer stem having a plurality of longitudinal grooves. The butt stock is not rigidly fixed to the buffer stem, which serves as the backbone of the assembly, but is free to move longitudinally thereon. The buffer stem is rigidly attached to a buffer plate, which acts as the interface between the butt stock assembly and the remainder of the rifle. The longitudinal grooves of the buffer stem permit debris that may accumulate within the butt stock to exit the butt stock. This reduces the likelihood that the buffer stem and butt stock will become jammed because of sand or grit therebetween. In addition to the longitudinal grooves, slots and holes can be made in the buffer stem to further reduce its weight.

In one embodiment of the present invention the buffer stem also has, on one side and spanning a portion of the buffer stem's length, a rack of transverse teeth. The rack spans a substantial portion of the length of the buffer stem but typically less than five (5) inches. Underneath the rack of teeth is a locking assembly. The locking assembly, made of a stiff, durable material such as aluminum or steel, is comprised of a toothed foot, and a four-member over-center lock. A lever can be added to make locking and unlocking the over-center lock easier. Although the teeth on the toothed foot are like those on the rack of the buffer stem, the toothed foot has far fewer teeth than does the rack.

The locking assembly is attached to the butt stock via the butt plate. The locking assembly has a "locked" and "unlocked" position and the user changes the position of the locking assembly using the lever. When in the "locked position," the lever is stowed against the bottom of the butt stock and the toothed foot of the locking assembly is raised and engages the rack of teeth in the buffer stem, securing the locking assembly (as well as the butt stock and butt plate) with respect to the buffer stem (and remainder of the rifle). When in the "unlocked position," the aft end of the lever is pivoted down and away from the butt stock, the toothed foot is pulled away from the rack of teeth, and the locking assembly (along with the butt stock and butt plate) is free to slide longitudinally on the buffer stem. Although this particular embodiment utilizes a rack of teeth and a toothed foot, the present invention is not limited to this arrangement. Any means of engagement between the foot and the buffer stem is acceptable (e.g. posts and blind holes, friction plates, etc.).

The four members comprising the over-center lock are a driving bracket, an oblong fork, a floating member, and an ankle. All four members have two pivot points at which other members of the lock are attached. (The ankle has a third pivot point at which the toothed foot is pivotally attached.) Each pivot point consists of a hole or a shaft or some other means of pivotal attachment. No more than two members attach at any given pivot point.

The oblong fork, which is rigidly attached to the butt plate and acts as the chassis upon which the other members are mounted, flexes when the lock is being "locked" or "unlocked" Mounting the oblong fork on the butt plate, which is typically made of a strong and stiff material such as aluminum or steel, provides a more sturdy and secure fastening point for the oblong fork (and therefore the lock) than if the oblong fork was mounted to the body of the butt stock, which is typically plastic.

The oblong fork has one short tine and, below that, one long tine. Both tines of the oblong fork have pivot points at their distal ends so that other lock members can be pivotally attached thereto. The driving bracket is pivotally attached to the long tine pivot. The ankle is pivotally attached to the short tine pivot. In addition to being pivotally attached to the oblong fork, the driving bracket and the ankle are also pivotally attached to the floating member. The point at which the driving bracket is attached to the floating member is the midpoint pivot. The point at which the driving bracket is attached to the floating member is the ankle driver pivot.

A line drawn from the long tine pivot to the ankle driver pivot is known as the threshold. When the over-center lock is "locked" or "unlocked," the midpoint pivot crosses the threshold and the oblong fork flexes. When the midpoint pivot crosses the threshold, the oblong fork is more flexed than at any other time. When the over-center lock is in the "locked" position, the midpoint pivot is above the threshold, closer to the rack. When the over-center lock is in the "unlocked" position, the midpoint pivot is below the threshold and away from the rack. Importantly, when the midpoint is above the threshold (i.e. the lock is "locked" and the toothed foot is engaging the rack), the flexed oblong fork tends to push the midpoint up and toward the rack and away from the threshold. This ensures that the toothed foot remains engaged with the rack of teeth (i.e. that the lock assembly, when "locked," stays "locked").

To "unlock" the lock, the aft end of the lever is pulled down and away from the butt stock and the lever and driving bracket pivot about the long tine pivot. As the driving bracket pivots about the long tine pivot, the midpoint pivot crosses the threshold and rotates down and away from the rack. This pulls the floating member and ankle away from the rack as well, disengaging the toothed foot from the rack. The lock assembly, butt plate, and butt stock, are then free to slide as a single unit longitudinally over the buffer stem.

When the user has moved the lock, butt plate, and butt stock to the desired location (i.e. the optimal pull length has been achieved), the user then "locks" the lock. To "lock" the over-center lock, the user pulls the aft end of the lever up and toward the butt stock. This rotates the lever and driving bracket toward the rack. As the driving bracket rotates toward the rack, the midpoint pivot moves toward the threshold from below. As the midpoint pivot nears the threshold and the toothed foot engages the rack, the counterforce from the rack pushes the midpoint pivot away from the threshold. The user at this point must increase pressure on the lever to flex the oblong fork and force the midpoint pivot across the threshold. As the midpoint crosses the threshold, however, the now flexed oblong fork tends to push the midpoint pivot up and toward the rack, ensuring that the over-center lock stays in the "locked" position.

Because only a short range of motion (less than 90 degrees) is required to "lock" and "unlock" the over-center lock (i.e. pivoting the lever toward and away from the butt stock), the length of the butt stock assembly and, therefore, the pull length can be quickly and simply adjusted. Moreover, the butt stock is comprised of only four subassemblies that are held together with a single pin. The pin, which goes through the butt stock, lock assembly, and butt plate, is retained (i.e. not permitted to become fully detached from the butt stock) during disassembly to ensure that the butt stock assembly can be reassembled after cleaning or maintenance. In addition, because the over-center lock maintains a certain amount of internal tension within the butt stock assembly, the butt stock assembly is quiet and will not rattle when transported or shaken.

The present invention is also a butt stock with an adjustable cheek rest. Specifically, overlaying the top of the butt stock (and shaped substantially in conformity therewith) is a saddle-shaped rigid cheek rest, which can be adjusted up and down with respect to the butt stock. The cheek rest is biased in the forward direction by a spring-loaded biasing saddle and has vertical ridges on its interior surface dimensioned to cooperate with opposing vertical grooves in the biasing saddle. The interior sides of the cheek rest also have horizontal tabs dimensioned to cooperate with opposing horizontal posts and delta-shaped tabs in the sides of the butt stock. The horizontal tabs of the cheek rest and the posts and tabs of the butt stock are separated when the cheek rest is manually moved in the aft direction. When the horizontal tabs and ridges are separated, the cheek rest is free to be adjusted vertically.

Alternatively, the interior sides of the cheek rest can have detent channels that cooperate with the horizontal posts on the sides of the butt stock. The detent channels are "zig-zag" shaped and permit the cheek rest to be manually biased forward and aft and thereby adjusted vertically. When released, the biasing saddle ensures that the cheek rest remains engage with the horizontal posts of the butt stock.

These and other features and their advantages will be apparent to those skilled in the art of rifle making from a careful reading of the Detailed Description of Embodiments accompanied by the following drawings.

DETAILED DESCRIPTION OF THE INVENTION

Figure 1:
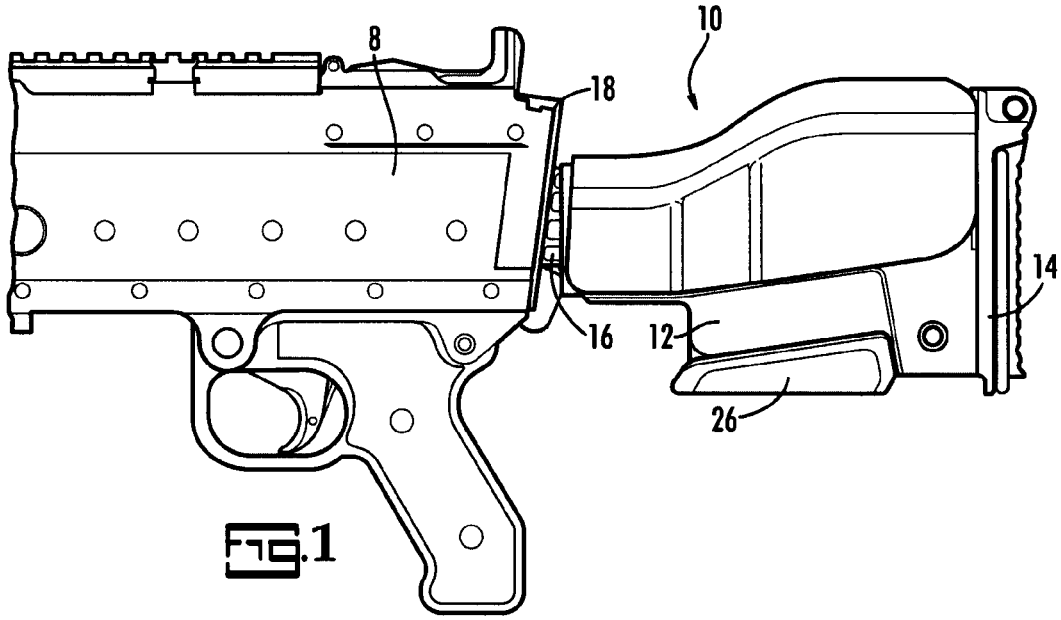
FIG. 1 is a side view of a one embodiment of the present invention attached to a rifle receiver.

The present invention is an adjustable butt stock assembly for use on a rifle. A side view of a preferred embodiment of the present invention 10 installed on a rifle receiver 8 is shown in FIG. 1. Attached to receiver 8 is buffer plate 18. Buffer plate 18 serves as the interface between the butt stock assembly 10 and receiver 8 and is made of a very strong material such as steel or aluminum to provide a rigid, durable link between the butt stock assembly 10 and receiver 8. Protruding aft from the buffer plate 18 is buffer stem 16. Buffer stem 16 extends into butt stock 12. Aft of butt stock 12 is butt plate 14, which engages the user's shoulder when the rifle is being aimed or fired. The lock assembly 13 (FIG. 3) enables the user to "lock" and "unlock" butt stock 12 from buffer stem 16 so that the butt stock can be extended or retracted (thereby adjusting the pull length of the rifle). A lever 26 can be added to the over-center lock to make "locking" and "unlocking" the over-center lock easier.

Figure 2:
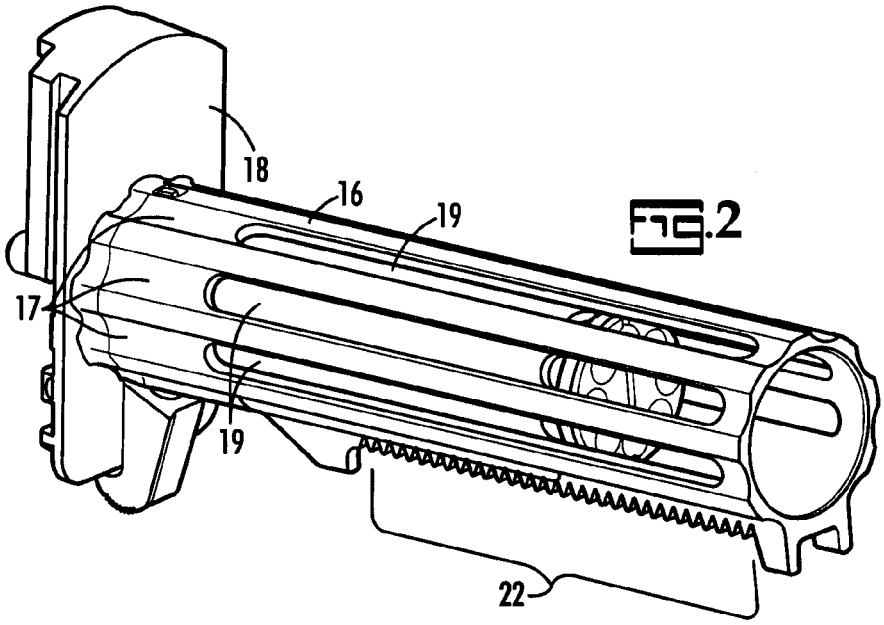
FIG. 2 is a perspective detail of one embodiment of the buffer assembly of the present invention.

FIG. 2 is a detailed view of the buffer plate 18 and buffer stem 16. Buffer stem 16 acts as the spine of the butt stock assembly 10 (FIG. 1) and is made of a strong, stiff material such as aluminum, steel, or a composite polymer to support the other components of butt stock assembly 10 (FIG. 1). Buffer stem 16 has several longitudinal grooves 17 that permit debris to exit butt stock 12 so that the debris does not prevent butt stock 12 from sliding smoothly over buffer stem 16. Also, buffer stem 16 has a number of slots 19 therein to reduce its mass. On the bottom of buffer stem 16 is rack of teeth 22. Rack 22, while spanning a substantial portion of buffer stem 16, is typically no more than five (5) inches long.

Figure 3:
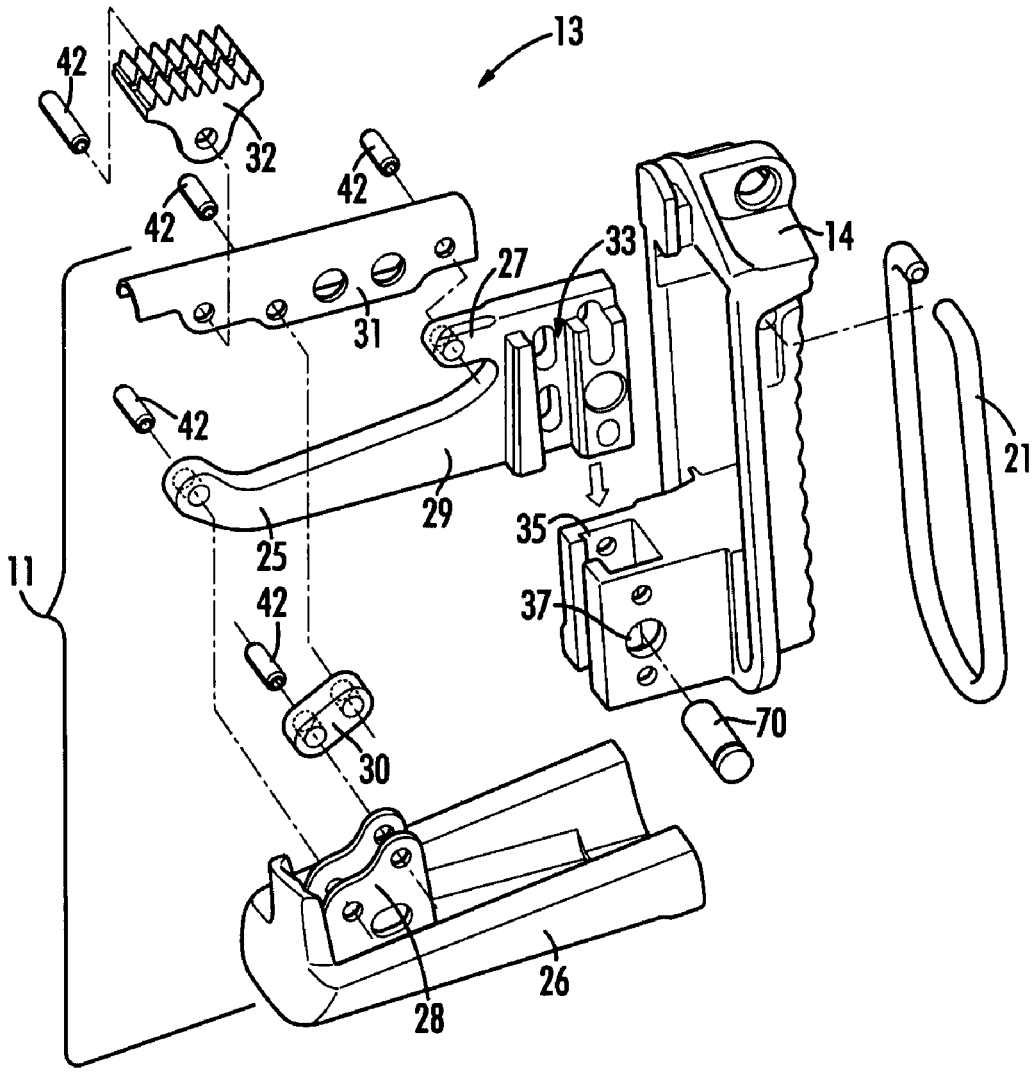
FIG. 3 is an exploded perspective view of one embodiment of the lock assembly of the present invention.
Figure 13:
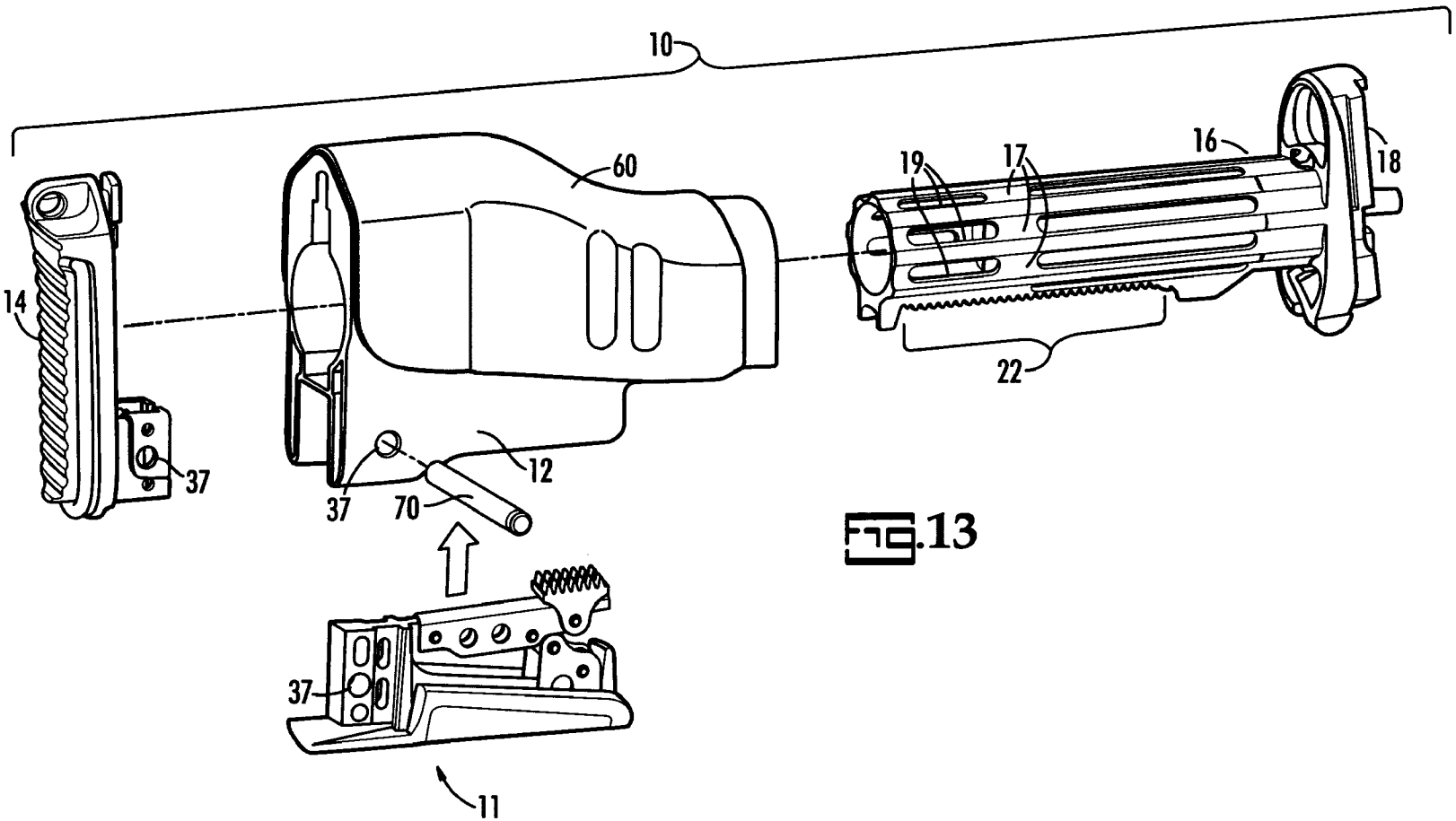
FIG. 13 is an exploded perspective view of the butt stock assembly of the present invention showing the four sub-assemblies.

FIG. 3 shows an exploded perspective view of the lock assembly 13. Lock assembly 13 is comprised of butt plate 14, lever 26, toothed foot 32, and four-member, over-center lock 11. Butt plate 14, to which over-center lock 11 is mounted, is attached to butt stock 12 (FIG. 13). Lever 26 can be used to "lock" and "unlock" over-center lock 11, which causes toothed foot 32 to engage and disengage the rack of teeth 22 (FIG. 2), as further explained below. The four members comprising over-center lock 11 are driving bracket 28, oblong fork 29, floating member 30, and ankle 31. Oblong fork 29 has a long tine 25 and a short tine 27. Although roll pins 42 are shown connecting the lock members 28, 29, 30, and 31 to one another and ankle 31 to toothed foot 32, any means of pivotal connection would be appropriate.

The attachment between butt plate 14 and lock 11 must be very sturdy and rigid so that toothed foot 32, which is attached to lock 11, is able to firmly engage rack 22 (FIG. 2). To achieve this rigid attachment, the aft end of the oblong fork 29 has a vertical flanged rail 33 that slides within a vertical receiving slot 35 in the butt plate 14. To rigidly join the oblong fork 29 to the butt plate 14, the flanged rail 33 is inserted into the receiving slot 35 and then a pin 70 is inserted into through-hole 37, extending through one side of receiving slot 35, through the flanged rail 33, and then through the other side of receiving slot 35. Connecting the lock assembly 13 to the butt plate 14, which is typically made of aluminum or steel, as opposed to attaching it to butt stock 12, which is typically made of plastic, provides the sturdy and secure connection required to ensure that toothed foot 32 positively contacts rack 22. Butt plate 14 can also have a shoulder hook 21, which can be folded out and placed on top of the user's shoulder when the user is firing the rifle.

Figure 4:
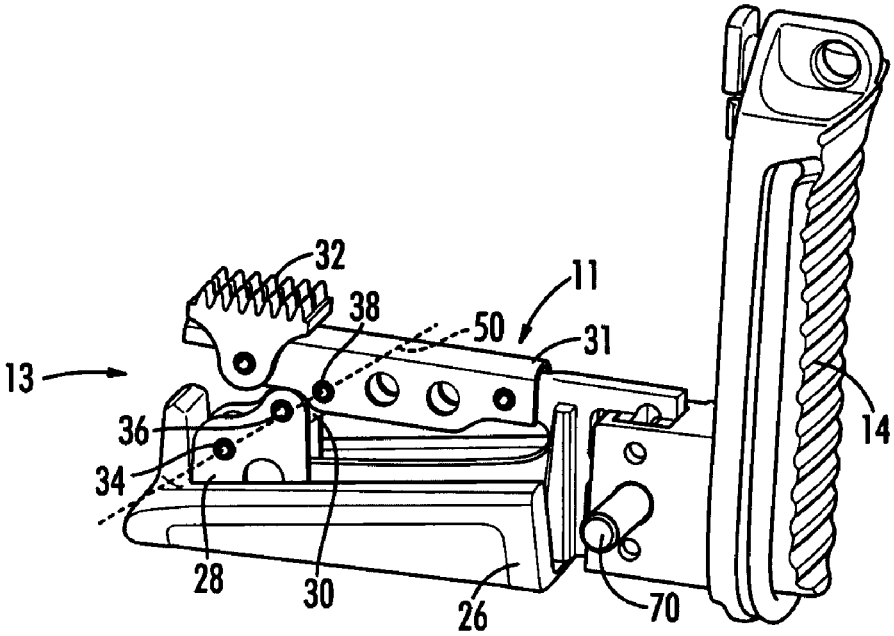
FIG. 4 is a perspective view of one embodiment of the lock assembly in the locked position.
Figure 5:
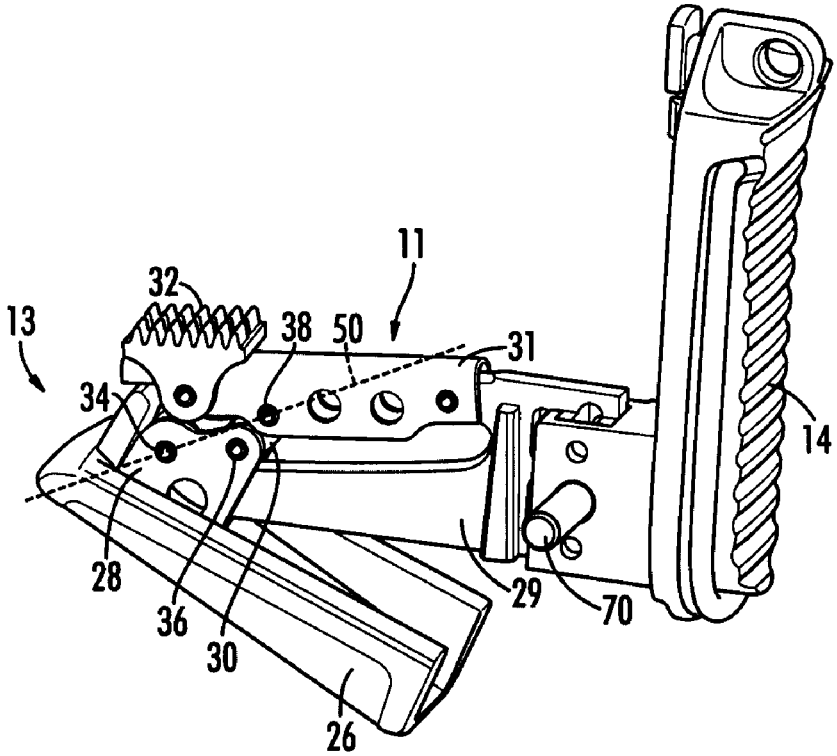
FIG. 5 is a perspective view of one embodiment of the lock assembly in the unlocked position.

The lock assembly 13 of FIG. 3 is shown assembled and in the "locked" and "unlocked" positions in FIGS. 4 and 5, respectively. FIGS. 4 and 5 also more plainly show the relative positions of the pivot points at which the members of over-center lock 11 are joined when the lock is in the "locked" and "unlocked" position. The pivot points of interest in terms of understanding the operation of over-center lock 11 are long tine pivot point 34, midpoint pivot 36, and ankle driver pivot 38. Specifically, the relative position of the midpoint pivot 36 to a line drawn between long tine pivot 34 and ankle driver pivot 38 is of particular interest. This line is threshold 50.

When over-center lock 11 is in the "locked" position as in FIG. 4, midpoint pivot 36 is slightly above threshold 50. When over-center lock 11 is in the "unlocked" position as in FIG. 5, midpoint pivot 36 is below threshold 50. Oblong fork 29, which flexes when over-center lock 11 is "locked" or "unlocked," tends to keep lock 11 in the "locked" or "unlocked" position, depending on whether midpoint pivot 36 is above or below threshold 50, respectively. When midpoint pivot 36 is above threshold 50, flexed oblong fork 29 tends to force midpoint pivot 36 higher, ensuring that over-center lock 11 stays "locked." When midpoint pivot 36 is just below threshold 50, flexed oblong fork 29 tends to force midpoint pivot 36 lower, ensuring that lock 11 remains "unlocked."

Of course, the user can overcome the tendency imposed by the oblong fork 29 by manually rotating lever 26. For example, when over-center lock 11 is in the "locked" position, as shown in FIG. 4, in order to "unlock" the lock, the user grabs the aft end of lever 26 and pulls it down thereby rotating driving bracket 28 about long tine pivot 34. As the midpoint pivot 36 approaches threshold 50 from above, causing oblong fork 29 to flex slightly, the toothed shoe 32 is briefly forced even more firmly toward rack 22 (FIGS. 1 and 2) and the user must apply more force to lever 26 to ensure that midpoint pivot 36 crosses threshold 50. As soon as midpoint pivot 36 is below threshold 50 (FIG. 5), flexed oblong fork 29 tends to force midpoint pivot 36 away from rack 22. As midpoint pivot 36 is rotated below threshold 50 as seen in FIG. 5, floating member 30, ankle 31, and toothed shoe 32 are retracted and toothed shoe 32 disengages from rack 22 (FIG. 2). Note that the user is required to rotate lever 26 far less than ninety (90) degrees to "unlock" over-center lock 11 and permit the pull length to be adjusted. This enables the user to adjust the pull length very quickly.

Once the lock is "unlocked" and the toothed foot 32 is disengaged from the rack 22, the user is able to slide butt stock 12 (with butt plate 14 and lock assembly 13) along buffer stem 16 (FIG. 2) to achieve the desired pull length. When the user has achieved the desired pull length, the user pulls the aft end of lever 26 up toward butt stock 12 (FIG. 1). Referring now to FIG. 5, midpoint pivot 36 is below threshold 50 when the user begins to rotate lever 26 to "lock" over-center lock 11. Accordingly, as midpoint 36 approaches threshold 50 from below, toothed foot 32 begins to bear on rack 22 (FIGS. 1 and 2) requiring the user to apply even more pressure to lever 26 to flex oblong fork 29 and force midpoint pivot 36 across threshold 50. Once midpoint pivot 36 crosses threshold 50, the pressure on toothed foot 32 will tend to push midpoint pivot 36 even farther above threshold 50, thus ensuring that the now "locked" over-center lock 11 stays "locked." This tendency prevents lock 11 from inadvertently becoming "unlocked" as the rifle is being used. With toothed foot 32 firmly engaging rack 22, butt stock 12 can no longer slide along buffer stem 16 and the rifle's pull length is fixed.

The same forces that ensure that over-center lock 11 stays "locked," also ensure that the components of the over-center lock 11 are not loose with respect to one another. This prevents lock 11 from making undue noise when the rifle is being transported or repositioned. Likewise, the fact that the lock assembly 13 has so few parts makes the lock assembly 13 more reliable and reparable.

Figure 6A:
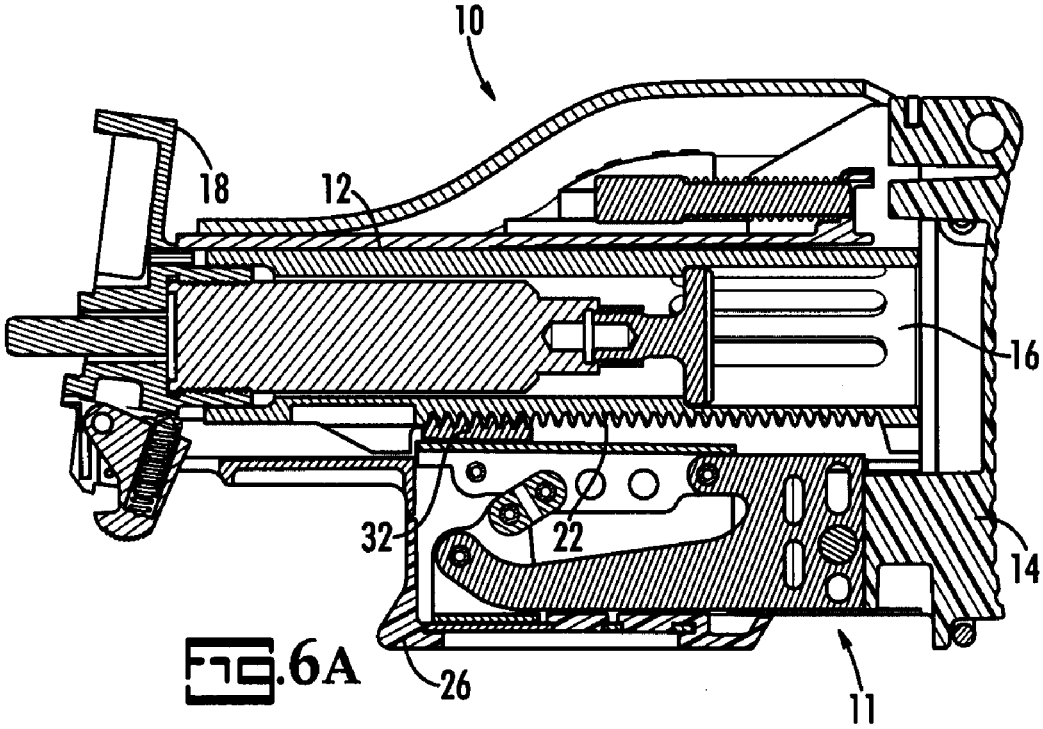
FIG. 6A is a cross-sectional view of one embodiment of the present invention when retracted and locked.
Figure 6B:
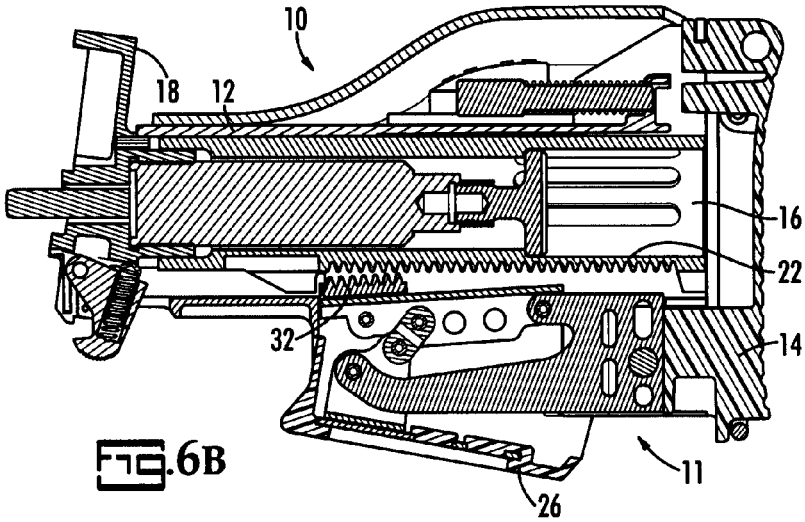
FIG. 6B is a cross-sectional view of one embodiment of the present invention when retracted and unlocked.
Figure 6C:
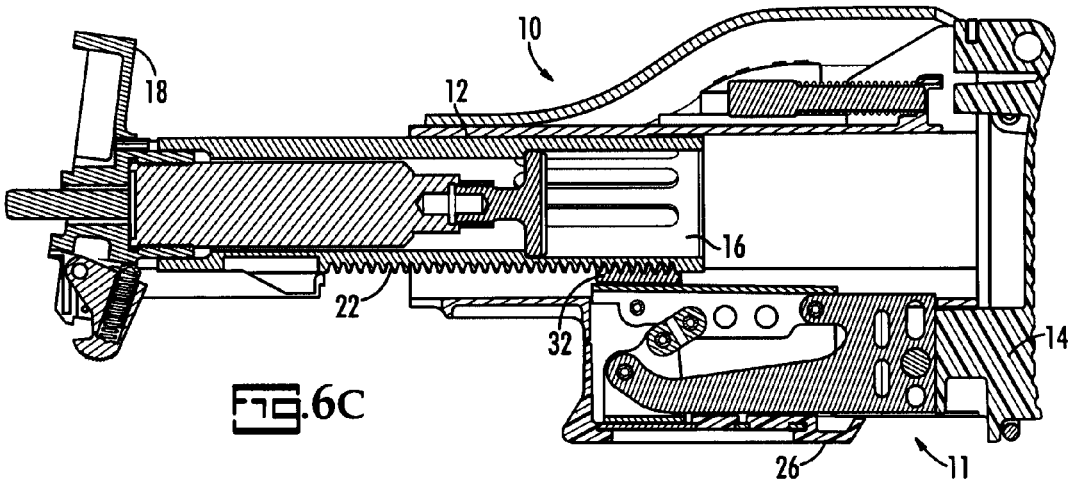
FIG. 6C is a cross-sectional view of one embodiment of the present invention when extended and locked.

FIGS. 6A, 6B, and 6C show one embodiment of the butt stock assembly of the present invention in the retracted and locked, retracted and unlocked, and extended and locked orientations, respectively. In FIG. 6A, lever 26 is collapsed against the lock assembly 11 and the toothed foot 32 is engaged with rack of teeth 22. With the toothed foot 32 and the rack of teeth 22 engaged, the butt stock 12 cannot move with respect to buffer stem 16. Moreover, with the toothed foot 32 engaging the forward most portion of the rack of teeth 22, the butt stock assembly 10 is in its most retracted orientation resulting in the shortest pull length.

In FIG. 6B, lever 26 has been pivoted away from lock assembly 11 and the toothed foot 32 is disengaged from rack of teeth 22. This permits butt stock 12 to be moved longitudinally with respect to buffer stem 16. FIG. 6C shows one embodiment of the butt stock assembly 10 of the present invention with the butt stock 12 in the extended position with respect to buffer stem 16. In FIG. 6C, as in FIG. 6A, the lever 26 is collapsed against lock assembly 11. However, in FIG. 6C, unlike FIG. 6A, toothed foot 32 is engaged with the aft-most portion of the rack of teeth 22. The butt stock assembly 10 is therefore in the most extended orientation resulting in the longest possible pull length.

Figure 7:
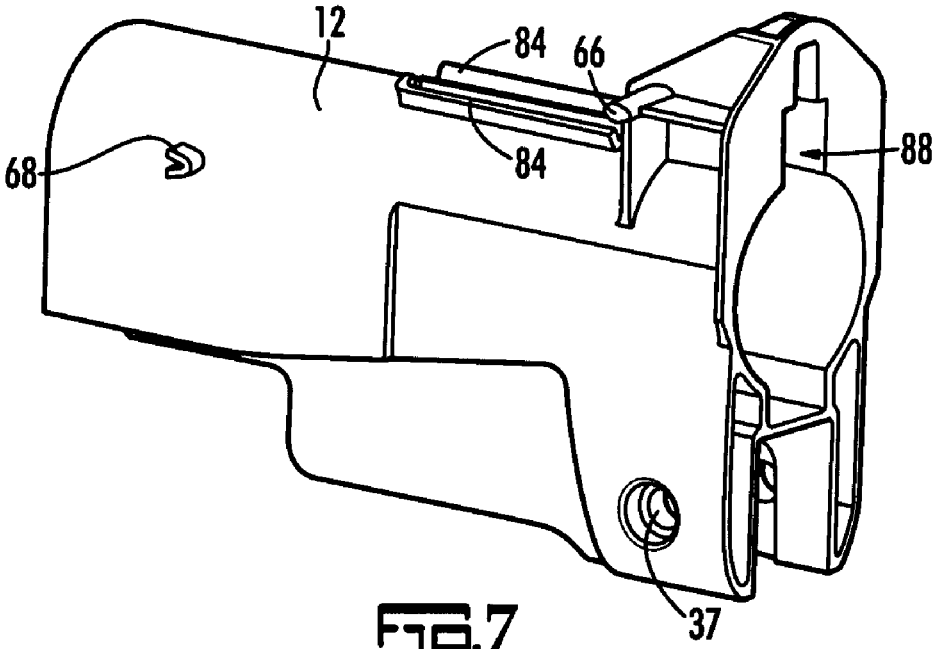
FIG. 7 is a perspective detail of the butt stock of one embodiment of the present invention.
Figure 8:
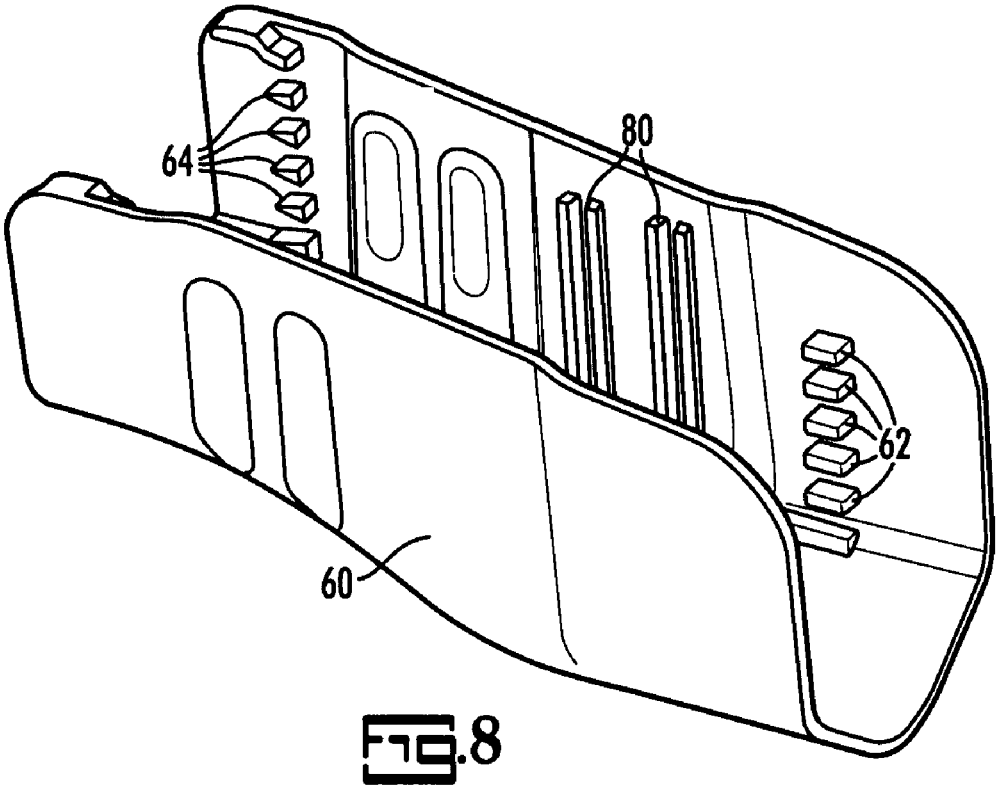
FIG. 8; is a perspective detail of the cheek rest of one embodiment of the present invention
Figure 9:
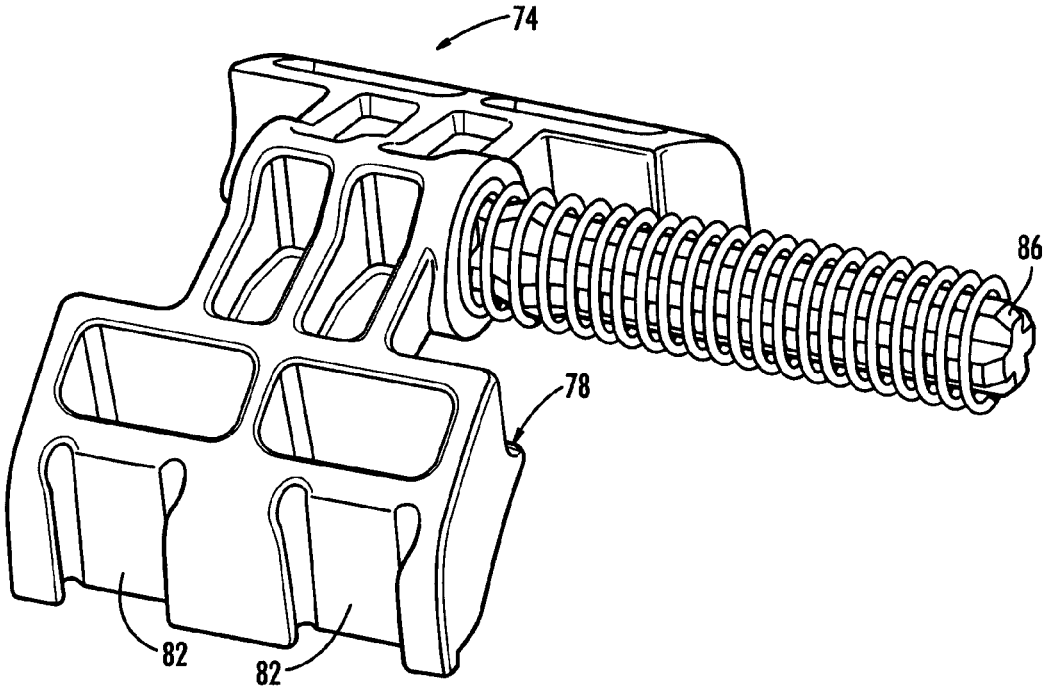
FIG. 9 is a perspective detail of the biasing saddle of one embodiment of the present invention.

The cheek rest of the present invention is vertically adjustable. FIGS. 7, 8, and 9 show the butt stock 12, cheek rest 60, and biasing saddle 74, respectively, of one embodiment of the present invention. FIG. 7 is a detail of butt stock 12 and shows delta traps 68 and butt stock posts 66. These two features interact with delta tabs 64 and aft tabs 62 (shown on the inside of cheek rest 60 in FIG. 8) to vertically secure cheek rest 60 with respect to butt stock 12. Specifically, the delta traps 68 of butt stock 12 capture delta tabs 64 of cheek rest 60 and butt stock posts 66 of butt stock 12 slide between aft tabs 62 of cheek rest 60. Moreover, the interaction between delta tabs 64 and delta traps 68 ensures that cheek rest 60 cannot move in the forward direction.

In order to adjust the height of cheek rest 60 with respect to butt stock 12, the user simply pulls cheek rest 60 backward thereby releasing delta tabs 64 from delta traps 68 and butt stock posts 66 from aft tabs 62, adjusts vertically cheek rest 60 to achieve the desired height with respect to butt stock 12, and releases cheek rest 60. Accordingly, in mere seconds and without any tools, the user is able to adjust cheek rest 60 to the desired height with respect to butt stock 12.

Biasing saddle 74 (FIG. 9), which is biased by spring 72, ensures that delta tabs 64 remain in delta traps 68 and butt stock posts 66 remain in aft tabs 61, thereby preventing cheek rest 60 from inadvertently moving vertically with respect to butt stock 12. Specifically, biasing saddle 74, which is longitudinally slidably attached to the top of butt stock 12 and vertically slidably attached to cheek rest 60, biases cheek rest 60 in the forward direction. Biasing saddle 74 is longitudinally slidably attached to butt stock 12 by inserting flanged ridges 84 of butt stock 12 into T groove 78 of biasing saddle 74. Biasing saddle 74 is vertically slidably attached to cheek rest 60 by inserting cheek rest ridges 80 into saddle slots 82. Biasing saddle post 86 extends through post hole 88 in butt stock 12 (FIG. 7). Spring 72 extends, which slides over biasing saddle post 86 extends into post hole 88 but is too large to extend all the way through butt stock 12.

Figure 10:
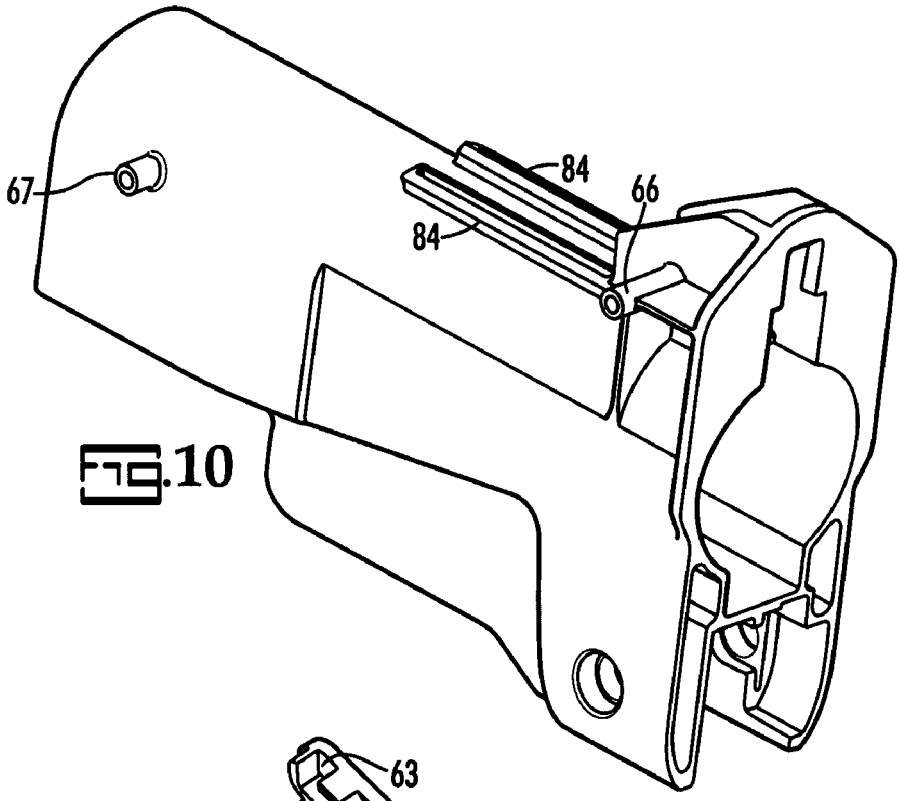
FIG. 10 is a perspective detail of the butt stock of an alternative embodiment of the present invention.
Figure 11:
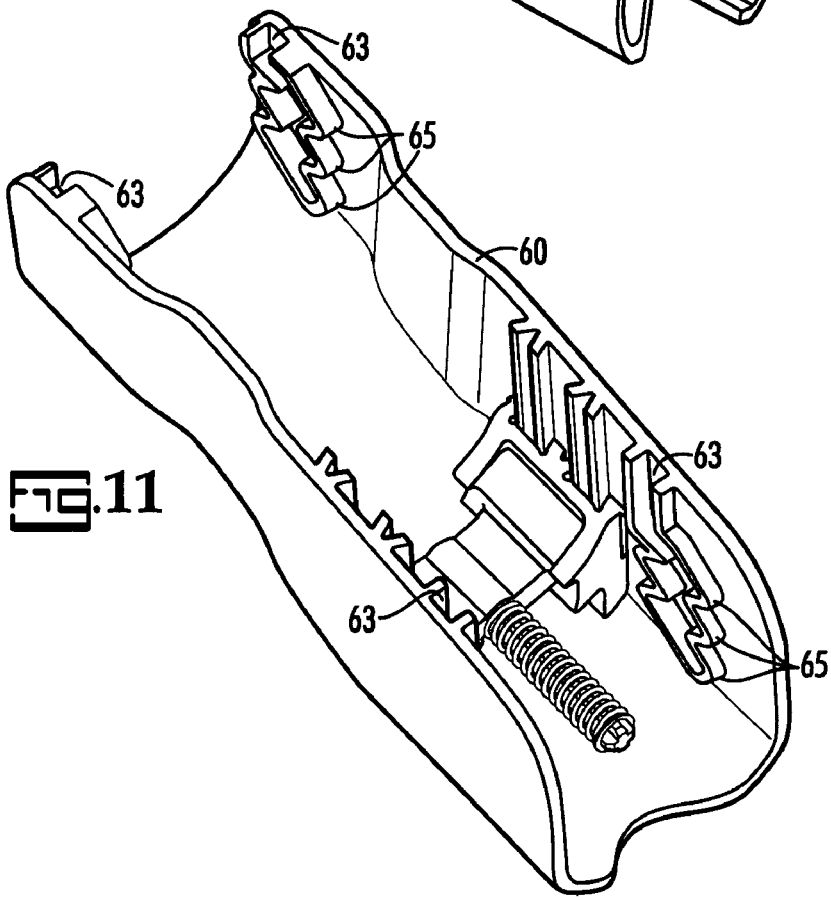
FIG. 11 is a perspective detail of the cheek rest of an alternative embodiment of the present invention.

FIGS. 10 and 11 show an alternative embodiment of butt stock 12 and cheek rest 60. FIG. 10 shows an embodiment of butt stock 12 wherein the delta traps 68 of the first embodiment of butt stock 12 (FIG. 7) have been replaced by another set of posts 67. FIG. 11 shows an embodiment of cheek rest 60 wherein the delta tabs 64 and aft tabs 62 of the first embodiment of cheek rest 60 (FIG. 8) have been replaced by detent channels 63. In this alternative embodiment, the posts 66 and 67 in butt stock 12 slide through detent channels 63. As with the first embodiment, the biasing saddle 74 (FIG. 9) biases the cheek rest 60 forward to keep posts 66 and 67 in aft portions 65 of detent channels 63. To adjust the height of cheek rest 60, the user simply pulls the cheek rest 60 aft with respect to the butt stock 12 and moves the cheek rest up or down to shift butt stock posts 66 and 67 to a new aft portion 65 of detent channels 63.

Figure 12:
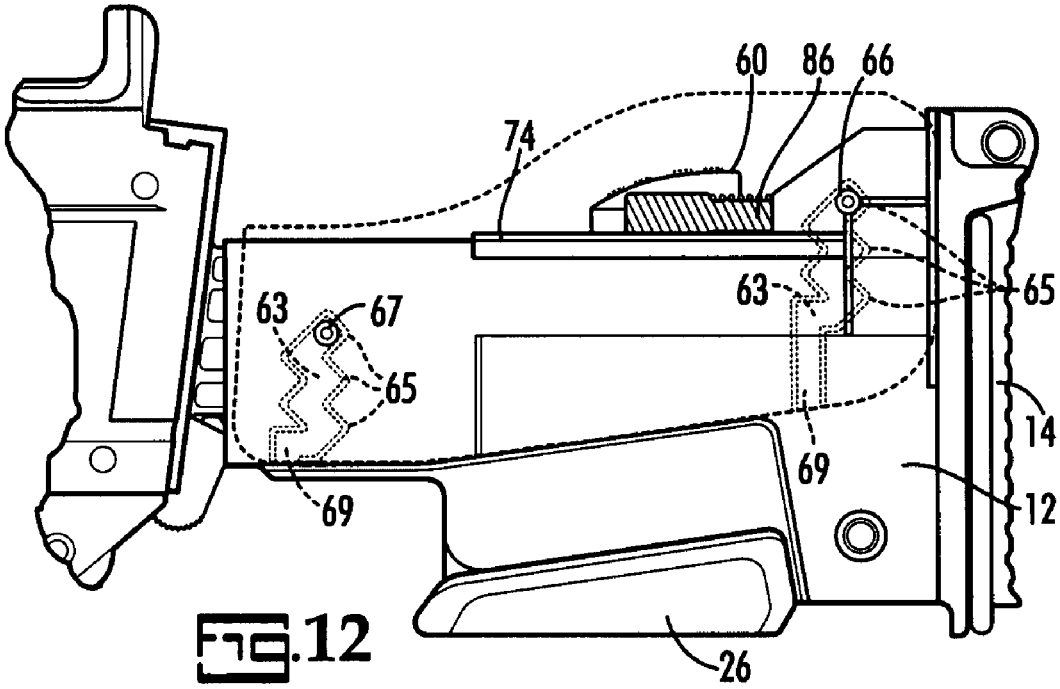
FIG. 12 is a side view of an alternative embodiment of the present invention with the cheek rest rendered transparent.

FIG. 12 is a side view of the alternative embodiment of the butt stock 12 and cheek rest 60 wherein the cheek rest 60 has been rendered transparent for illustrative purposes. FIG. 12 shows that posts 66 and 67 fit into and can slide within detent channels 63. Cheek rest 60 can be removed from butt stock 12 entirely by moving cheek rest 60 back and forth with respect to butt stock 12 until posts 66 and 67 exit detent channels 63 at vertical exit channels 69. Note that vertical exit slots 69 are slightly forward of the rest of detent channels 63. Cheek rest 60, which rides with biasing saddle 74 in the forward and aft directions, can only be adjusted sufficiently aft with respect to butt stock 12 and posts 66 and 67 when butt plate 14 is removed. This is because, when butt plate 14 is attached, biasing saddle post 86 (FIG. 9), which extends aft through butt stock 12, engages butt plate 14 and prevents the user from moving cheek rest 60 sufficiently aft to allow posts 66 and 67 to enter exit channels 69. This prevents the user from inadvertently removing cheek rest 60 during adjustment.

FIG. 13 is an exploded view of one embodiment of the present invention showing the manner in which the entire butt stock assembly 10 can be disassembled into four subassemblies simply by removing a single pin 70. To assemble the butt stock assembly 10, the user simply inserts buffer stem 16 and butt plate 14 into the fore and aft ends of butt stock 12, respectively. Then, the user inserts lock 11 into butt plate 14 and butt stock 12. Pin 70 is then inserted in through-hole 37 to hold the subassemblies together. Note also that pin 70 is a retained pin. That is, pin 70 cannot be removed entirely from the butt stock assembly because it is equipped with a retaining ring (not shown) that is too large to exit through-hole 37 of butt stock 12.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. An adjustable butt stock assembly, comprising:

a buffer stem carrying a rack of transverse teeth;

a butt stock, said butt stock having a forward end and an aft end and a first longitudinal hole therethrough dimensioned to receive said buffer stem;

an over-center lock assembly attached to said butt stock and having an aft end and a fore end, a locked and an unlocked orientation, said over-center lock assembly having a lever with a fore end and an opposing aft end, said fore end of said lever being pivotally attached to said fore end of said over-center lock assembly; and a toothed foot carried by said over-center lock assembly, said toothed foot also having transverse teeth, said butt stock being fixed with respect to said buffer stem when said aft end of said lever is pivoted upward to bring said toothed foot of said over-center lock assembly into engagement with said transverse teeth of said rack of teeth and adjustable with respect to said buffer stem when said aft end of said lever is pivoted downward to bring said toothed foot out of engagement with said transverse teeth of said rack of teeth.

2. The adjustable butt stock assembly of claim 1, further comprising:

a lever, said lever being attached to said over-center lock so that said lever can be used to transition said over-center lock from said locked orientation to said unlocked orientation.

3. The adjustable butt stock assembly of claim 2 wherein said lever is rotated away from said butt stock to change said over-center lock from said locked orientation to said unlocked orientation and rotated toward said butt stock to change said over-center lock from said unlocked orientation to said locked orientation.

4. The adjustable butt stock assembly of claim 3 wherein said lever is rotated less than ninety degrees to change said over-center lock from said locked orientation to said unlocked orientation.

5. The adjustable butt stock assembly of claim 1 wherein said buffer stem has a plurality of longitudinal grooves therein to permit debris to exit from between said buffer stem and said butt stock.

6. The adjustable butt stock assembly of claim 1 wherein said buffer stem has a plurality of longitudinal slots therein to reduce the mass of said buffer stem.

7. The adjustable butt stock assembly of claim 1 wherein said buffer stem has a plurality of holes therein to reduce the mass of said buffer stem.

8. The adjustable butt stock assembly of claim 1, further comprising:

a butt plate, said butt plate being attached to said aft end of said butt stock so that when a user uses said adjustable butt stock assembly, said user's shoulder engages said butt plate.

9. The adjustable butt stock assembly of claim 8, further comprising:

a pin;

wherein said butt stock, said over-center lock, and said butt plate have transverse holes therethrough dimensioned to receive said pin so that said over-center lock and said butt plate are attached to said butt stock.

10. The adjustable butt stock assembly of claim 9 wherein said pin is dimensioned so that it cannot be completely removed from said butt stock.

11. An adjustable butt stock assembly, comprising:

a buffer stem;

a butt stock, said butt stock having a forward end and an aft end and two opposing sides therebetween, said sides having opposing posts extending outward therefrom and opposing traps extending outward therefrom; said butt stock having a first longitudinal hole therethrough dimensioned to receive said buffer stem so that said butt stock slides over said buffer stem;

a saddle-shaped cheek rest dimensioned to overlay said butt stock, said cheek rest having two substantially parallel spaced apart sides joined by a curved top, said sides having opposing forward tabs extending inward therefrom and dimensioned to engage said traps of said butt stock and opposing aft tabs extending inward therefrom dimensioned to engage said posts of said butt stock;

a biasing saddle, said biasing saddle longitudinally slidably attached to said butt stock and vertically slidably attached to said cheek rest, said biasing saddle and said cheek rest biased forward with respect to said butt stock by a spring bearing on said butt stock so that said forward tabs of said cheek rest engage said traps of said butt stock and said aft tabs of said cheek rest engage said posts of said butt stock and so that a user can adjust the height of said cheek rest with respect to said butt stock by manually pulling said cheek rest aft with respect to said butt stock thereby disengaging said forward tabs of said cheek rest from said traps of said butt stock and said aft tabs of said cheek rest from said posts of said butt stock, repositioning vertically said cheek rest with respect to said butt stock, and releasing said cheek rest;

an over-center lock attached to said butt stock and having a locked and an unlocked orientation, said over-center lock engaging said buffer stem when in said locked orientation and not engaging said buffer stem when in said unlocked orientation so that said butt stock is fixed with respect to said buffer stem when said over-center lock is locked and longitudinally slidably adjustable with respect to said buffer stem when said over-center lock is in said unlocked orientation.

12. An adjustable butt stock assembly, comprising:

a buffer stem;

a butt stock, said butt stock having a forward end and an aft end and two opposing sides therebetween, said forward end having a pair of opposing transverse posts extending outward therefrom, said aft end of said butt stock having a pair a pair of opposing transverse posts extending outward therefrom, said butt stock having a first longitudinal hole therethrough dimensioned to receive said buffer stem so that said butt stock slides over said buffer stem;

a saddle-shaped cheek rest dimensioned to overlay said butt stock, said cheek rest having a forward end, an aft end, and two substantially parallel spaced apart sides joined by a curved top, said forward end having a pair of opposing detent channels extending inward therefrom and dimensioned to engage said posts of said forward end of said butt stock, said aft end having a pair of opposing detent channels extending inward therefrom and dimensioned to engage said posts of said aft end of said butt stock, all of said detent channels extending vertically and having a forward and aft zigzag shape;

a biasing saddle, said biasing saddle longitudinally slidably attached to said butt stock and vertically slidably attached to said cheek rest, said biasing saddle and said cheek rest biased forward with respect to said butt stock by a spring bearing on said butt stock so that said posts of said butt stock reside in aft portions of said detent channels and so that a user can adjust the height of said cheek rest with respect to said butt stock by manually pulling said cheek rest aft with respect to said butt stock thereby removing said posts of said butt stock to move out of said aft sections of said detent channels and then releasing said cheek rest so that said posts of said butt stock are repositioned in adjacent aft portions of said detent channels of said cheek rest;

an over-center lock attached to said butt stock and having a locked and an unlocked orientation, said over-center lock engaging said buffer stem when in said locked orientation and not engaging said buffer stem when in said unlocked orientation so that said butt stock is fixed with respect to said buffer stem when said over-center lock is locked and longitudinally slidably adjustable with respect to said buffer stem when said over-center lock is in said unlocked orientation.

13. The adjustable butt stock assembly of claim 12 wherein said detent channels have substantially vertical and substantially straight exit portions permitting said posts to exit said detent channels.

14. The adjustable butt stock assembly of claim 12 wherein said exit portions are the forward-most portions of said detent channels.

15. The adjustable butt stock assembly of claim 13, further comprising:

a spring post on said biasing saddle, said spring post extending aft and dimensioned to slide into said spring;

a second longitudinal hole in said butt stock, said second longitudinal hole having a forward end and an aft end, said forward end dimensioned to receive said spring post and said spring, said aft end dimensioned to receive said spring post but not said spring; and wherein said spring post is sufficiently long so that, when said butt plate is attached to said butt stock and said cheek rest and said biasing saddle are manually moved aft on said buffer stem, said spring post engages said butt plate preventing said posts of said cheek rests from entering said exit portions of said detent channels.

16. The adjustable butt stock assembly of claim 12 wherein said cheek rest is made of a composite polymer.

* * * * *